United States Patent [19]

De Schamphelaere et al.

[11] Patent Number: 4,636,060

[45] Date of Patent: Jan. 13, 1987

[54] ELECTROSTATIC COPYING METHOD INCLUDING COMPENSATION FOR PHOTOCONDUCTOR FATIGUE AND DARK RECOVERY

[75] Inventors: Lucien A. De Schamphelaere, Edegem; Freddy M. Librecht, Boechout; Willy G. Verlinden, Edegem, all of Belgium

[73] Assignee: Agfa-Gevaert N.V., Mortsel, Belgium

[21] Appl. No.: 703,661

[22] Filed: Feb. 21, 1985

[30] Foreign Application Priority Data

Feb. 28, 1984 [EP] European Pat. Off. ..... 84200278.4

[51] Int. Cl.[4] ..... G03G 15/00

[52] U.S. Cl. ..... 355/14 CH; 355/14 R; 355/14 CU; 430/902

[58] Field of Search ..... 355/14 CH, 14 C, 14 CU, 355/14 D, 14 R; 361/235; 430/902

[56] References Cited

U.S. PATENT DOCUMENTS 3,575,505 4/1971 Parmigiani ..... 355/14 DY
4,512,652 4/1985 Buck et al. ..... 355/14 CH

FOREIGN PATENT DOCUMENTS 53-116157 10/1978 Japan ..... 355/14 CH
54-73055 6/1979 Japan ..... 355/14 CH

OTHER PUBLICATIONS

*Research Disclosure,* Jun. 1976, Disclosure No. 14612, Stephens, C. L., "Electrophotographic Apparatus Having Compensation for Changes in Sensitometric Properties of Photoconductors", pp. 4–6.

*Primary Examiner*—Arthur T. Grimley

*Assistant Examiner*—J. Pendegrass

*Attorney, Agent, or Firm*—William J. Daniel

[57] ABSTRACT

A method of producing toner-developed electrostatic images involving the repetitive performance of a copying cycle comprising the steps of corona charging a photoconductive layer at a determined voltage level, information-wise photo-exposing said charged photoconductive layer, developing the exposed photoconductor with charged toner particles to a toner image, transferring the applied toner image to a receptor, and restoring the photoconductive layer to a rest potential for the next cycle; and between successive copying cycles, maintaining said photoconductor in the dark for a randomly varying time period. The number of performed copying cycles in each series is registered by electronic means and an output signal is generated; the period of time between series that the photoconductor is maintained in the dark is measured and a corresponding output signal is generated. The respective output signals are inputed to electronic control means which (a) based on a relation between the actual surface potential of the photoconductor and the number of copying cycles performed in a series, measures the voltage change in the photoconductor surface from the actual number of cycles in a series, (b) based on a relation between the actual change in surface potential of the photoconductor and the dark recovery duration measures the voltage change in the surface potential after an actual dark recovery period, (c) and then gives a combined control signal indicating the overall change in surface potential from the beginning of one series of cycles to the beginning of the next series. Finally, the corona voltage is regulated substantially according to the combined control signal.

5 Claims, 2 Drawing Figures

ELECTROSTATIC COPYING METHOD INCLUDING COMPENSATION FOR PHOTOCONDUCTOR FATIGUE AND DARK RECOVERY

The present invention relates to the production of developed electrostatic images.

In electrophotography an electrostatic latent image is obtained with an electrophotographic material typically comprising a photoconductive insulating layer on a conductive support. Said layer is given a uniform surface charge in the dark, normally by corona-charging, and is then exposed to an image pattern of activating electromagnetic radiation such as light or X-rays. The charge on the photoconductive layer is dissipated in the irradiated area to form an electrostatic charge pattern which is then developed with an electrostatically attractable marking material also called toner. The marking material, whether carried in an insulating liquid or in the form of a dry powder deposits on the exposed surface in accordance with either the charge pattern or the discharge pattern as desired. If the photoconductive layer is of the re-usable type, e.g. a vacuum-deposited amorphous selenium-layer on a metal drum, the toner image is transferred to another surface such as paper and then fixed to provide a copy of the original.

A variety of development techniques is available e.g. cascade development, magnetic brush development, single component dry development and electrophoretic development which development techniques are described in detail by Thomas L. Thourson in "Xerographic Development Processes: A review"—IEEE Transactions on Electron Devices, Vol. ED-19, No. 4, April 1972. Magnetic brush development is suited for direct as well as reversal development. Reversal development is of interest for photocopying from negative to positive or when the exposure of the photoconductive layer is an exposure to an information-wise modulated laser beam or to light from light-emitting diodes and the information to be recorded is represented by the exposed area of the photoconductive layer.

In order to obtain uniform development results when using a re-usable type photoconductive layer in cyclical copying the photoconductive layer should be uniformly charged to a predetermined level prior to the image-wise exposure.

Charging is conventionally effected by a corona discharging device examples of which are known under the names "corotron" and "scorotron" which are described in R. M. Schaffert "Electrophotography" —The Focal Press—London, New York, Ed. 1975 p.234–245. The "scorotron" is a grid controlled corona charging device in which a grid is located between the corona discharge electrode and the photoconductive layer and is biased with a DC-voltage to the surface potential desired for the photoconductive layer.

In practice, development quality tends to vary during cyclical copying. From our research and experiments it has been found that an important cause of this variation is fatigue of the photoconductive layer. Fatigue effects have been found to be manifest during performance of a string of copying cycles, i.e. a plurality of cycles following immediately one after another, the extent of the fatigue depending on the length of the string, i.e. on the number of constituent copying cycles, or, in other terms, on the length of time for which the copying cycles continue without interruption. On the other hand, during rest periods following a string of copying cycles, the fatigue effects tend to wear off, in the sense that the chargeability of the photoconductive layer, assessed in terms of the charge level to which the layer will be raised by exposure to a given charging, tends to recover.

It is one of the objects of the present invention to provide a method for a more reproducible production of developed electrostatic images on an electrophotographic recording material.

It is more particularly an object of the present invention to provide such method offering improved charging reproducibility by the use in said method of a controlled corona-charging.

It is still another object of the present invention to provide an electrophotographic recording apparatus incorporating means for automatically controlling corona charging of a photoconductive layer, whereby image quality deviations due to fatigue of the photoconductive layer are reduced or avoided.

According to the present invention, there is provided a method of producing developed electrostatic images involving the repetitive performance of a copying cycle comprising the steps of electrostatically charging a photoconductive layer by means of a corona discharge, information-wise photo-exposing said photoconductive layer to electromagnetic radiation to which it is sensitive, applying electrostatically charged toner particles to develop the resulting electrostatic charge pattern, information-wise transferring the applied toner to a receptor, and restoring the photoconductive layer to a rest potential preparatory to the next cycle, characterised in that:

(i) during the performance of a string of copying cycles, i.e. a series of copying cycles which follow immediately one after another, the number of performed copying cycles of such string is registered by electronic means as they are performed;

(ii) the period of time elapsing between any two immediately successive strings of copying cycles is registered by electronic means, and (iii) the voltage level of the corona source for charging the photoconductive layer at the start of a copying cycle is automatically controlled in dependence on signals indicative of the last data registrations (i) and (ii) so that such voltage level is varied from one cycle to another in a way which at least partly compensates for variations in the chargeability of the photoconductive layer attributable to fatigue and dark recovery.

By adopting a method according to the present invention as above defined, more uniform development results are obtainable during performance of strings of copying cycles, regardless of the duration of such strings. And before a further copying cycle is commenced, following the termination of a string of copying cycles, account is taken of the effects on the chargeability of the photoconductive layer of the intervening so-called dark recovery period.

The appropriate signals for controlling the voltage level of the corona source can be generated by an electronic control means to which signals representing the number of performed cycles of a string and the duration of a following dark recovery period are fed and in which signals are stored representing experimentally derived data quantifying the changes in the chargeability of the photoconductive layer which are associated with different lengths of copying cycle string and with different dark recovery periods.

In preferred embodiments of the invention, signals indicative of the data registrations (i) and (ii) above specified are applied as input signals to electronic control means which, on the basis of an experimentally defined equation indicative of variations in the chargeability of the photoconductive layer in function of the number of copying cycles performed as a string, and on the basis of an experimental equation indicative of variations in the chargeability of said layer in function of the duration of a dark recovery period immediately preceding the layer charging step, has been programmed to yield output signals effective for controlling the said corona source voltage level so as at least partially to compensate for the chargeability of the photoconductive layer resulting from the circumstances indicated by said data registrations (i) and (ii), and said output signals are used for controlling the voltage level of the corona source.

Our researches have also established that the chargeability of the photoconductive layer is affected by changes in its temperature. An increase in the temperature of the layer, can, depending on the magnitude of the increase, result in a decrease in its chargeability. In certain embodiments of the present invention, changes in the temperature of the photoconductive layer are sensed and registered by electronic means to control the corona source voltage by signals indicative of such temperature changes so that the variations in the voltage level of the corona source also at least partly compensate for variations in the chargeability of the photoconductive layer attributable to such temperature changes. The introduction of this further, temperature-dependent, control factor, enables variations in the chargeability of the photoconductive layer, when used under actual working conditions which involve changes in the temperature of such layer, to be reduced to a greater extent than they would otherwise be. The level (voltage value) to which the photoconductive layer is charged can therefore be kept more nearly constant from cycle to cycle.

The invention includes methods as hereinbefore defined and wherein changes in the temperature of the photoconductive layer are sensed, and signals indicative of such changes are fed to electronic control means, e.g. a microprocessor which, on the basis of experimental data indicative of variations in the chargeability of the photoconductive layer in function of its temperature, has been programmed to yield output signals effective for controlling the voltage level of the corona source so as at least partially to compensate for the changes in the chargeability of the photoconductive layer resulting from the temperature changes indicated by said temperature change signals, and said output signals are used in the control of said corona source voltage level.

Changes in the temperature of the photoconductive layer can be sensed by directly sensing changes in the temperature of said layer or by sensing the temperature of the atmosphere in the vicinity of said layer.

The experimental data for use as a basis for programming an electronic control means as above referred to can be obtained by measuring under test conditions the levels (voltage values) to which the photoconductive layer is charged by the corona discharge, while keeping the corona source at a constant potential relative to ground, for various values of each of the parameters mentioned, namely the number of performed copying cycles in a string (the individual cycles being of the same time duration), the time interval between any two immediately successive strings of copying cycles, and the temperature of the photoconductive layer.

When effecting successive image developments by toner particles deriving from a batch of developer material which comprises toner particles and magnetically susceptible carrier particles of larger size, to which the toner particles electrostatically adhere, the developing capability of the toner in the residual batch tends to vary as the batch becomes depleted. Our researches have established that this phenomenon is attributable to the fact that in course of time the surfaces of the carrier particles in the batch become smeared with toner material. This smearing results in a change in the triboelectric behaviour of the developer material. It has been found that variation in the developing capability of a said developer material can be reduced or avoided by applying the developer material by means of a magnetic brush which is voltage-biased relative to an electrically conductive backing of the photoconductive layer, and controlling the voltage bias in function of the number of copying cycles in which the batch of developer material is used. In said method the toner used for the development step in the different copying cycles is derived from a common batch of developer material which comprises a toner-carrier mixture and which is carried to the photoconductive material by a magnetic brush while the latter is at a bias voltage with respect to an electrically conductive backing of the photoconductive layer, the method being characterized in that the total number of copying cycles performed from the commencement of use of said batch of developer material is automatically registered as the cycles are performed and the said bias voltage is automatically controlled in dependence on signals indicative of such number of performed copying cycles so as at least partly to compensate for a decrease in the charge density on the toner particles of said batch as its toner content decreases. Such a voltage-biased magnetic brush development can be utilised in carrying out the present invention.

The information-wise photo-exposure of the photoconductive layer can involve simultaneous exposure of all parts of the layer to be irradiated, or a progressive exposure of the image area, e.g. by line-wise scanning. The method according to the invention can be employed for document copying. The method can also be employed for recording information transmitted as energising or triggering signals to the exposing radiation source or sources. The term "copying" where used herein is to be construed broadly to include such a translation of information signals into a developed visible record.

The control signals for controlling the corona discharge can be used directly to control the high voltage generator of the corona source.

The restoration of the photoconductive layer to rest potential to complete a copying cycle is achieved by overall exposing the layer to light.

Electronic circuitries for converting input signals into output signals whose value relationship to the input signals is determined in accordance with a stored function or programme are well known in the art of electronic control devices. For effecting the required signal conversion in carrying out the present invention, use is preferably made of a microprocessor which on the basis of experimental data and resulting equations as above referred to has been programmed to yield output signals suited for control of corona source voltage.

A microprocessor is by definition an integrated-circuit computer, a computer on a chip called the central processing unit (CPU). The microprocessor has only a relatively small signal storage capacity (memory), and a small number of input/output lines. A microprocessor plus a few associated chips and some ROM (read-only memory) can replace a complicated logic circuit of gates, flip-flops and analog/digital conversion functions. In carrying out the present invention use can be made of a microprocessor which includes a signal memory and a comparator circuit for determining which signals are equivalent. Examples of useful comparator circuits are given by Paul Horowitz and Winfield Hill in the book "The Art of Electronics"—Cambridge University Press—Cambridge (1980) p. 124–125, 337–338 and 390–392. The 8022 microprocessor illustrated in Section 8.27 of said book includes eight comparator gates on the same chip in the processor itself, in addition to an 8-bit analog-to-digital converter. Electronic circuits known as voltage regulators and power circuits are described in the same book at pages 172–222.

The invention includes apparatus for use in producing developed electrostatic images by a method according to the invention as hereinbefore defined. The apparatus according to the invention for producing developed electrostatic images comprises a recording element comprising a photoconductive layer, corona discharge means for electrostatically charging such layer, means for information-wise exposing said layer to electromagnetic radiation to which it is sensitive thereby to form an electrostatic latent image, means for applying electrostatically charged toner particles to develop said latent image, means for effecting information-wise transfer of such applied toner to a receptor element, and means for restoring said photoconductive layer to a rest potential preparatory to another recording cycle, characterised in that the apparatus includes:

(i) means which functions during the performance of a string of copying cycles, i.e. a series of copying cycles which follow immediately one after another, to register automatically the number of performed copying cycles of such string as they are performed and to yield output signals indicative of the registered number, (ii) means which functions to register the period of time elapsing between any two immediately successive strings of copying cycles and to yield output signals indicative of such period of time;

(iii) electronic control means which functions in dependence on said output signals from means (i) and (ii) to control automatically the voltage level of the corona source to effect charging of the photoconductive layer at the start of a copying cycle so that said voltage level is varied from one cycle to another in a way which at least partly compensates for variations in the chargeability of the photoconductive layer attributable to fatigue and dark recovery.

An example of the present invention will now be described with reference to the accompanying drawings.

Figure 1:
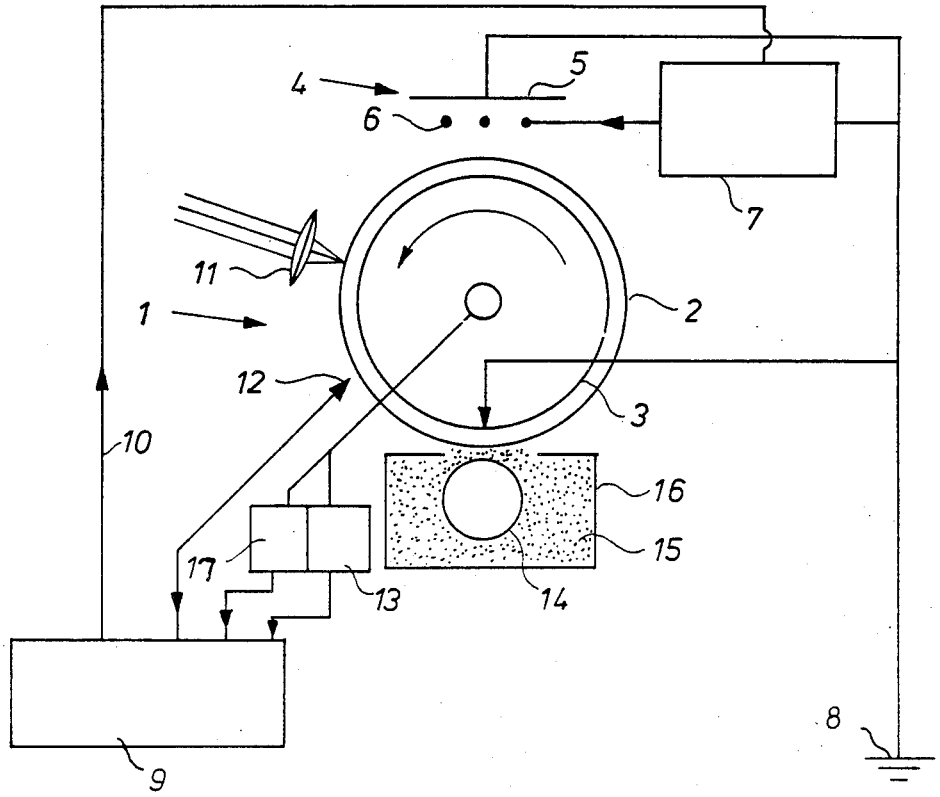
FIG. 1 is a block diagram of a copying embodiment according to the present invention.

Referring now in detail to FIG. 1, element 1 represents a drum 1 comprising a photoconductive layer 2 on a conductive drum wall 3. While rotating the drum 1 in the indicated sense the photoconductive layer 2 is corona charged with the corona device 4 comprising a grounded shield 5 and corona wires 6. The corona wires 6 are connected to e.g. the positive pole of a high voltage D.C. corona voltage source 7. The voltage source 7 is connected to a microprocessor 9 having an output 10 providing a control signal for the potential level of the source 7 of the corona device 4 which control signal is generated (i) in response to the stored signal of a pre-measured temperature value that is found by a comparator of the microprocessor to be equivalent with the registered equivalent with the signal of the actual temperature of the atmosphere near photoconductive layer 2, and (ii) in response to the computing of the actual chargeability (i.e. obtainable voltage level of the photoconductive layer at constant corona voltage) taking into account:

(A) from the start with a fresh (fully dark adapted) photoconductive layer, (1) any string of already performed copying cycles and the number of copying cycles contained therein;

(2) any period of time elapsed between any two immediately successive strings of copying cycles, and (3) the number of already performed copying cycles in the running string of copying cycles, and (B) the experimental equations found for the voltage level drop of the photocondcutive layer as a function of the number of copying cycles in a string and the raise of voltage level again as a function of dark adaptation time.

Element 11 represents an exposure unit which may be a lens type exposure device as in a camera or an electronically actuated exposure device e.g. laser beam or an array of light-emitting diodes which are information-wise operated for the printing of digital data.

Element 12 is a temperature sensor arranged in the atmosphere near the photoconductive layer 2. The sensor generates as a function of temperature an electrical signal which is fed into the electronic control means being a microprocessor 9. Element 13 is a copy counter counting the number of copies in a sequence of copying cycles (string) and generating in correspondence therewith an input signal for the microprocessor 9. Element 17 is a clock measuring the dark-adaptation time between two strings of copying cycles and generating in correspondence therewith an input signal for the microprocessor 9. The output 10 of the microprocessor 9 provides in response to electronic operations as defined under (i) and (ii) above, the necessary control signals for controlling the voltage level of the corona voltage source 7 for obtaining a constant charging level on the photoconductive layer under different work-load conditions.

The development of the electrostatically charged and image-wise exposed photoconductive layer 2 is a reversal development proceeding with a magnetic brush 14 rotating in a tray 15 filled with a mixture 16 of electrostatically charged toner particles and magnetically susceptible carrier particles.

For defining by experiment the equation for the chargeability of the photoconductive layer, the obtained voltage level ($V_n$) on the photoconductive layer, when operating with a constant voltage of the corona source in an uninterrupted series (string) of a number (n) of normal information-wise exposures (18 copies per minute) is measured (pre-measurement). The voltage drop after a number (n) of copies is defined as:

$$(\Delta V_n)=600\ V-V_n$$

For a particular arrangement using a photoconductive layer of Se-As alloy applied on an aluminium drum said values ($\Delta V_n$) indicative for the chargeability of the photoconductive layer were experimentally established to correspond to the following equation (1):

$$\Delta V_n=68\cdot(1-e^{-n/2.5})+70\cdot(1-e^{-n/200})\ \text{(volt)}$$

wherein:

n is the number of copies, e is the base of the natural system of logarithms.

Figure 2:
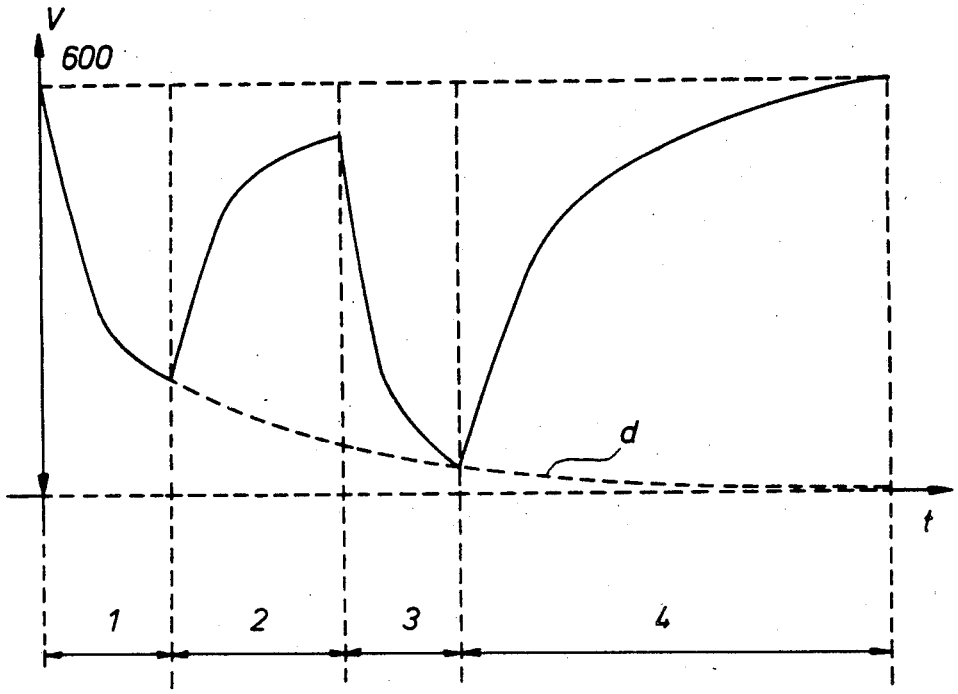
FIG. 2 represents a diagram of the change of the charging of the photoconductive layer expressed in volt (V) versus time including different strings of copying cycles separated by a particular dark-adaptation period (non-copying time), the corona-wire voltage level being kept constant i.e. capable of charging the photoconductor up to 600 V when the latter is in fresh (fully dark-adapted) state.

The decrease of the voltage level ($V_n$) with increasing copy number in one continued copying sequence follows an exponential course (see the dashed line d in FIG. 2).

In the same arrangement using the above-mentioned photoconductive layer of Se-As alloy the change of chargeability of the photoconductive layer expressed as voltage level ($V_t$) after a certain dark-adaptation time was experimentally established. The voltage increase ($\Delta V_t$) as a function of time is given in equation (2):

$$\Delta V_t=68\cdot(1-e^{-3t})+70\cdot(1-e^{-t/10})\ \text{(volt)}$$

wherein:

t is the time expressed in minutes, and e has the same meaning as defined above.

The voltage drop after a number (n) of copies and a consecutive dark recovery time (t) is given by:

$$\Delta V=\Delta V_n-\Delta V_t$$

FIG. 2 represents a diagram of changes in charge level of the photoconductive layer in volt (V) versus time (t) in a particular embodiment including a first string of copying cycles 1, a stand-by (dark-recovery) period 2, a second string of copying cycles 3 and another stand-by period 4 of a duration long enough for a practically complete regaining of the original charge level (600 V).

In said embodiment the maximum charge level of the photoconductive layer in fresh state was 600 V and the charge level drop was about 138 V for an uninterrupted copying period (copy number n=1,000), such in accordance with equation (1).

The charge level variation of the photoconductive layer by temperature is likewise determined experimentally. In a practical embodiment using the already mentioned photoconductive layer of a particular Se-As alloy the temperature coefficient determining the charge level expressed as voltage level of that layer was experimentally established to be −6 V/°C. in the temperature range of 20° C. to 40° C.

We claim:

1. In a method of producing toner-developed electrostatic images involving the repetitive performance of a copying cycle comprising the steps of electrostatically charging a photoconductive layer by means of a corona discharge at a determined voltage level, information-wise photo-exposing said charged photoconductive layer to electromagnetic radiation to which it is sensitive, applying electrostatically charged toner particles to said exposed photoconductor to develop the resulting electrostatic charge pattern as a toner image, information-wise transferring the applied toner image to a receptor, and restoring the photoconductive layer to a rest potential preparatory to the next cycle; and after completion of one series of copying cycles, but before the completion of the next series, maintaining said photoconductor in the dark for a randomly varying time period, the improvement wherein:

(i) during the performance of a given series of copying cycles following immediately one after another, the number of performed copying cycles in said series is registered by electronic means as they are performed and an output signal corresponding to said number is generated;

(ii) after the performance of one such series, the period of time that said photoconductor is maintained in the dark before the start of the next series is measured and an output signal corresponding to said time period is generated; and (iii)the respective output signals (i) and (ii) are applied as input signals to electronic control means which (a) on the basis of an experimentally developed relation establishing the actual charge surface potential of said photoconductor as a function of the number of copying cycles performed in a series, provides a measure of the voltage change on said photoconductor surface resulting from the actual number of cycles in said given series, (b) on the basis of an experimentally developed relation establishing the actual change in surface potential of said photoconductor as a function of the duration of the time period to which said photoconductor is maintained in the dark between said series of cycles, provides a measure of the voltage change in the surface potential of said photoconductor after the elapse of the actual period of time said photoconductor is maintained in the dark, (c) said two measures are combined to generate a control signal of a magnitude indicative of the overall change in surface potential of said photoconductor from the beginning of one series of cycles to the beginning of the next series, and (d) the voltage level of said corona discharge is regulated to a determined level substantially according to the magnitude of said control signal, whereby said corona discharge voltage level is controlled so as at least substantially to compensate for variations in the surface potential of the photoconductive layer resulting from both the number of copy cycles performed in a given series and the duration of the dark maintenance period between that series and the next.

2. Method according to claim 1 including the step of applying a biasing voltage to said toner particles.

3. Method according to claim 2 wherein said applied biasing voltage is controlled in response to the number of copying cycles registered in step (i).

4. Method according to claim 1, wherein the development is a reversal development.

5. Method according to claim 1, wherein the toner used for the development step in the successive series of copying cycles is derived from a common batch of developer material which comprises a toner-carrier mixture and which is applied to the photoconductive material while the latter is maintained at a bias voltage with respect to an electrically conductive backing of the photoconductive layer, and wherein the total number of copying cycles performed from the commencement of use of a given batch of developer material is registered as the cycles are performed and said brush bias voltage is controlled in dependence on such number of performed copying cycles so as at least partly to compensate for a decrease in charge density on the toner particles of said batch as its toner content decreases.

* * * * *